US011795410B2

(12) United States Patent
Kubitschke et al.

(10) Patent No.: US 11,795,410 B2
(45) Date of Patent: Oct. 24, 2023

(54) TCD-ESTERS FOR LOW TEMPERATURE LIQUID APPLICATIONS

(71) Applicant: OQ Chemicals GmbH, Monheim am Rhein (DE)

(72) Inventors: Jens Kubitschke, Düsseldorf (DE); Horst Lange, Bochum (DE); Christoph Balzarek, Krefeld (DE); Joachim Reimer, Mannheim (DE); Gina Prüss, Rheinberg (DE)

(73) Assignee: OQ CHEMICALS GMBH

( * ) Notice: Subject to any disclaimer, the term of this patent is extended or adjusted under 35 U.S.C. 154(b) by 0 days.

(21) Appl. No.: 17/795,158

(22) PCT Filed: Jan. 28, 2021

(86) PCT No.: PCT/EP2021/051964
§ 371 (c)(1),
(2) Date: Jul. 25, 2022

(87) PCT Pub. No.: WO2021/152001
PCT Pub. Date: Aug. 5, 2021

(65) Prior Publication Data

US 2023/0063112 A1 Mar. 2, 2023

(30) Foreign Application Priority Data

Jan. 29, 2020 (DE) ..... 10 2020 102 162.3

(51) Int. Cl.
*C10M 105/34* (2006.01)
*C10M 105/38* (2006.01)
*C10N 40/30* (2006.01)

(52) U.S. Cl.
CPC ..... *C10M 105/34* (2013.01); *C10M 105/38* (2013.01); *C10M 2207/2815* (2013.01); *C10M 2207/2835* (2013.01); *C10N 2040/30* (2013.01)

(58) Field of Classification Search
CPC ..... C10M 105/34; C10M 105/38; C10M 2207/2815; C10M 2207/2835; C07C 69/003; C10N 2040/30
See application file for complete search history.

(56) References Cited

U.S. PATENT DOCUMENTS 5,817,256 A * 10/1998 Weippert ..... C10M 101/02 560/194
2016/0331661 A1 11/2016 Masuno et al.

FOREIGN PATENT DOCUMENTS

CH 380711 A 8/1964
DE 934889 C 11/1955
(Continued)

OTHER PUBLICATIONS

Research on Effect of Ester Lubricant Structure on Its Performance, Jiang Huize et al., Contemporary Chemical Industry, vol. 44, No. 7, pp. 1570-1572.

(Continued)

*Primary Examiner* — Cephia D Toomer
(74) *Attorney, Agent, or Firm* — M. Susan Spiering; Ochoa & Associates, P.C

(57) ABSTRACT

The present invention relates to the use of esters of octahydro-4,7-methano-1H-indene-5-methanol (TCD-M) or -dimethanol (TCD-DM) and aliphatic C2-C18 monocarboxylic acids as lubricants in low temperature applications. In addition, the present invention relates to low-temperature lubricant compositions comprising said esters.

8 Claims, 4 Drawing Sheets

(56) References Cited

FOREIGN PATENT DOCUMENTS

| | | | |
|---|---|---|---|
| DE | 2917152 | A1 | 11/1979 |
| DE | 4437007 | A1 | 4/1996 |
| EP | 0445611 | A1 | 9/1991 |
| EP | 3098216 | A1 | 11/2016 |
| GB | 2019841 | A | 11/1979 |
| JP | 54144354 | A | 11/1979 |
| JP | 4218592 | | 8/1992 |
| JP | 09241214 | A | 9/1997 |
| JP | 2015137229 | | 7/2015 |

OTHER PUBLICATIONS

Written Opinion PCT/EP2021/051964.
International Search Report PCT/EP2021/051964, dated Apr. 14, 2021.
International Preliminary Report on Patentability dated Jul. 28, 2022.

* cited by examiner

Figur 6
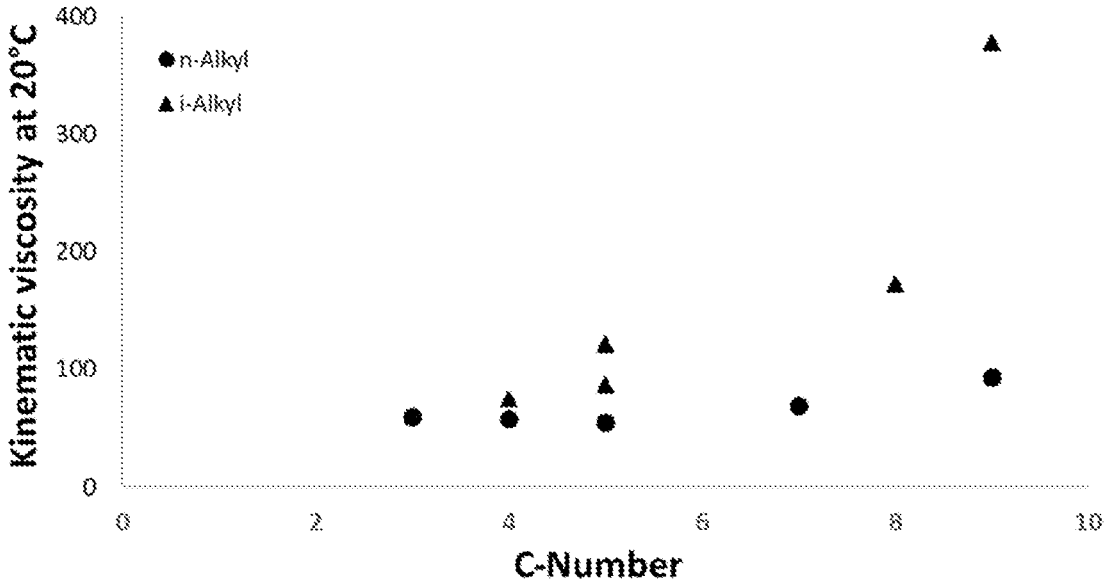

TCD-ESTERS FOR LOW TEMPERATURE LIQUID APPLICATIONS

CLAIM FOR PRIORITY

This application is a National Phase Application of Application No. PCT/EP2021/051964 filed Jan. 28, 2021 which was based on German Application No. 10 2020 102 162.3 filed Jan. 29, 2020. The priorities of the foregoing applications is hereby claimed and their disclosures incorporated herein by reference.

TECHNICAL FIELD

The present invention relates to the use of esters of octahydro-4,7-methano-1H-indene-5-methanol (TCD-M) or -dimethanol (TCD-DM) and aliphatic C2-C18 monocarboxylic acids as lubricants in low temperature applications. In addition, the present invention relates to low-temperature lubricant compositions comprising said esters.

BACKGROUND

Modern refrigeration is largely based on the use of mechanical refrigerant compressors, wherein various refrigerants are condensed or compressed in a first process step. Compression usually induces a phase transition of the refrigerant from gaseous to liquid, and the heat generated in the process is dissipated to the environment. In a second step, the liquid refrigerant is transferred to the place of cooling and here evaporated, with the energy required for evaporation then being extracted from this place. Depending on the device equipment and the desired cooling capacity, substances with large specific evaporation enthalpies, such as diethyl ether, ammonia, carbon dioxide, lower alkanes or halogenated hydrocarbons, can be used as refrigerants, although the latter, in particular, are justifiably being increasingly pushed into the background due to their harmful effect on the climate.

To protect the mechanical parts in low-temperature applications, such as refrigeration systems, lubricants have to be used that can guarantee "smooth" and low-maintenance operation. A wide variety of substances are used as lubricants. For example, lubricants based on mineral oil or esters such as dicarboxylic acid diesters and pentaerythritol tetraesters. Alternatives can be found in the class of natural esters, such as rapeseed oil esters. Esters are characterized by good lubricating properties and, in contrast to mineral oil-based products, are in most cases more biodegradable. Not available so far are ester oils which, in addition to sufficient lubricating properties as such, also exhibit improved secondary properties, such as a wide temperature working range, uniform rheological properties, sufficiently high viscosities and improved chemical stabilities.

The patent literature discusses a wide variety of approaches to lubricating oils in low-temperature applications such as refrigeration systems.

DE 44 37 007 A1, for example, discloses biodegradable oligoesters for use, inter alia, as lubricants with a kinematic viscosity of 50 to 50 000 mm2/s at 40° C., the esters being prepared from a tricyclic diol having 8 to 20 carbon atoms, a saturated, straight-chain or branched dicarboxylic acid having 4 to 20 carbon atoms and an aliphatic alcohol having 1 to 30 carbon atoms.

In another patent document, EP 2 342 312 B1, the use of a lubricant base composition comprising at least one ester obtained by esterifying 2-propylheptanoic acid with at least one 2,2-substituted 1,3-propanediol and/or at least one dimer, trimer or polymer thereof and/or at least one alkoxylated species of said 2,2-substituted 1,3-propanediol or said dimer, trimer or polymer thereof is disclosed, wherein said lubricant being suitable for internal combustion engines and turbine engines.

Furthermore, EP 0 406 479 B1 discloses the use of a lubricant for compressors using a chlorine-free hydrofluorocarbon refrigerant containing as a main component an ester or esters obtained by reacting (a) neopentyl glycol with (b) a mixture of at least one straight-chain monovalent fatty acid containing 5 to 10 carbon atoms and at least one branched-chain saturated fatty acid containing 7 to 9 carbon atoms, saturated fatty acid containing 5 to 10 carbon atoms and at least one branched chain saturated fatty acid containing 7 to 9 carbon atoms, the proportion of the branched chain monovalent saturated fatty acid being not less than 50 mol % of the total amount of monovalent saturated fatty acid used.

Despite the already known uses of substances as lubricants at low temperatures, there is still an increased need for further substance classes which are able to function as lubricants in low temperature applications. Furthermore, there is an interest in low-temperature lubricant compositions which, in addition to a sufficient lubricating effect, also comprise consistent rheological properties have a broader temperature operating range with.

SUMMARY OF INVENTION

It is therefore the task of the present invention to provide a new use for esters which overcomes, at least in part, the disadvantages of the previously known substances and permits a reliable use over a wide temperature range with consistent lubricant properties.

According to the invention, it is therefore proposed to use the esters of the invention as lubricants in low temperature applications according to claim 1. Furthermore, a low temperature lubricant composition according to claim 9 is proposed. Advantageous further embodiments of the use and the composition are given in the dependent claims, respectively. They may be combined as desired, unless the context clearly indicates otherwise.

BRIEF DESCRIPTION OF DRAWINGS

The invention is described in detail below with reference to the drawings, wherein:

FIG. 6 is a diagram showing the dependence of the kinematic viscosity of TCD DM esters as a function of the C number in the alkyl chains of the monocarboxylic acids.

DETAILED DESCRIPTION

Figure 1:
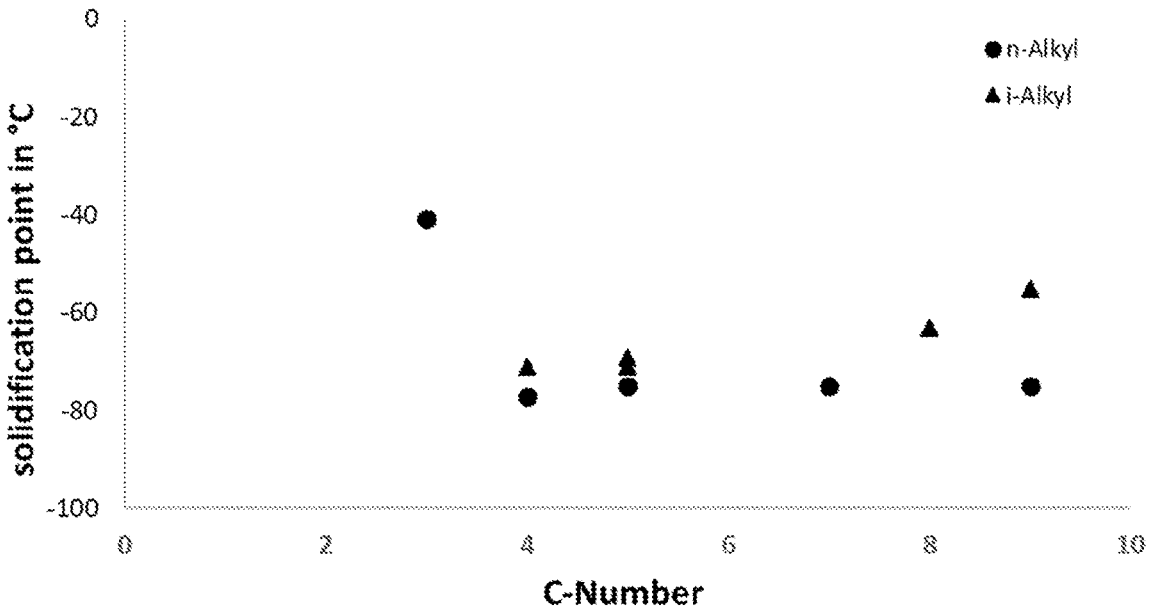
FIG. 1 is a diagram showing the dependence of the solidification point of TCD M esters as a function of the C number in the alkyl chains of the monocarboxylic acids.

According to the invention is the use of esters of octahydro-4,7-methano-1H-indene-5-methanol or -dimethanol and aliphatic C2-C18 monocarboxylic acids as lubricants in low temperature applications. Surprisingly, it has been found that the above-mentioned group of TCD mono- and di-esters are particularly suitable for use as lubricants in applications which are also operated at lower temperatures. In particular, the esters exhibit markedly suitable rheological and thermal properties over a wide temperature range, and especially at very low temperatures. The esters exhibit a very low solidification point and, as a function of temperature, only a slight change in viscosity. Furthermore, the usable esters according to the invention can provide an overall sufficiently high viscosity, so that even in difficult environmental conditions in high and low temperature ranges, a break-off of the lubricant film is not to be expected. These viscosity properties can help to reduce the maintenance requirements of refrigeration compressors or mechanical motors or gearboxes in general and can help to increase the longevity of the mechanical components. Another advantage is that the lubricants according to the invention are chemically very stable.

The group of esters according to the invention can be used as lubricants in low temperature applications. Lubricants, also called greases, are used for lubrication and serve to reduce friction and wear between mechanically moving parts. The moving parts in this case are mechanical components of an engine or gearbox or similar moving mechanical assemblies. Low-temperature applications include, for example, refrigeration systems or chillers, which use a compressor to transport heat energy from a colder location to be further cooled to a warmer environment. The purpose of a refrigeration system is thus to cool a specific area of the machine to a temperature below the ambient temperature. The applications are low temperature applications in which the lubricated mechanical parts necessary for the application are designed to operate, at least temporarily, at a temperature of less than or equal to 0° C., preferably less than −20° C., and further preferably to −40° C.

The use of esters according to the invention can be based on esters of octahydro-4,7-methano-1H-indene-5-methanol or of esters of octahydro-4,7-methano-1H-indenedimethanol and aliphatic C2 to C18 monocarboxylic acids. Thus, the alcohol moiety of the esters according to the invention can be octahydro-4,7-methano-1H-indene-5-methanol (TCD M) according to the following structure

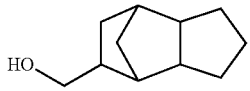

octahydro-4,7-methano-1H-indene-5-methanol (TCD alcohol M)

or the di-alcohol derivate thereof, i.e. octahydro-4,7-methano-1H-indenedimethanol (TCD DM)

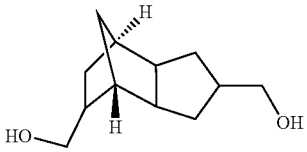

octahydro-4,7-methano-1H-indendimethanol (TCD alcohol DM)

can be used. The abbreviation TCD stands for TriCycloDecan. According to the TCD backbone used for esterification, mono-esters can form in the case of TCD M or di-esters in the case of TCD DM. The lack of a specific indication of the position of the alcohol groups in TCD DM also makes it clear that different structural isomers can exist for the TCD DM backbone.

The esters of the invention are obtained from the above-mentioned alcohols as the backbone and aliphatic C2 to C18 monocarboxylic acids which have formed an ester compound (R'—CO—OR) with one or, if present, with both alcohol groups of the backbone. Accordingly, the following ester base structures may be suitable for use according to the invention:

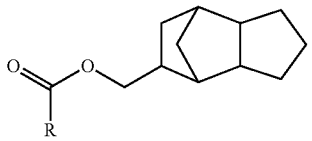

or

TCD M ester

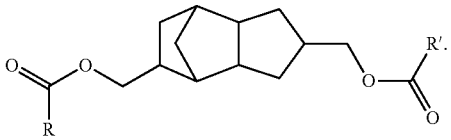

TCD DM ester

The aliphatic radicals R and R' of the monocarboxylic acids, including the carbon atom of the carboxylic acid group, can have 2 to 18 carbon atoms in the alkyl chain and can be selected, for example, from the group consisting of ethane, propane, butane, pentane, hexane, heptane and their homologous representatives up to octadecane. Accordingly, the carboxylic acid representatives of this homologous series can be used for esterification. The carboxylic acids which can be used according to the invention can be branched or unbranched (straight chained). Carboxylic acids not according to the invention are in particular the polycarboxylic acids with more than one carboxylic acid group, the cyclic as well as aromatic or unsaturated alkene or alkyne carboxylic acids.

Within a preferred embodiment of the invention the monocarboxylic acids can be selected from the group consisting of straight-chain or branched C2-C9 monocarboxylic acids or mixtures thereof. In particular, the TCD esters with shorter aliphatic chains of the corresponding shorter-chain monocarboxylic acids may be particularly suitable for lubricant applications. In particular, the esters from these carboxylic acids may have a low solidification point, as well as sufficient viscosity over a wide temperature range. In this application, the solidification point is also described by the pour point, which is the temperature at which the lubricants are still flowable, i.e. just before the esters solidify. The solidification point of these esters can in particular be lower than −35° C., preferably lower than −50° C. and furthermore preferably lower than −70° C. The particularly preferred viscosity properties can be seen in that, for example, this group of esters has a preferred viscosity index. For example, the viscosity index of this group of esters may preferably be greater than 40, further preferably greater than 50, and further preferably greater than 70. This group of esters is also characterized by the fact that the good lubricating properties are maintained both at high temperatures and down to very low temperatures.

In a preferred embodiment of the use the monocarboxylic acids can be selected from the group consisting of straight-chain monocarboxylic acids. Surprisingly, it has been found that the esters of straight-chain monocarboxylic acids according to the invention can have particularly lower solidification points. Especially, the solidification points of these esters can be significantly lower than the solidification points of esters obtained from branched monocarboxylic acids. Furthermore, these esters may also exhibit improved viscosity properties. For example, the viscosity index of esters of these monocarboxylic acids may be significantly higher than the viscosity index of esters obtained from branched monocarboxylic acids.

Within a preferred aspect of the use the monocarboxylic acids can be selected from the group consisting of monocarboxylic acids comprising an odd C-number. In particular, the solidification points of esters with monocarboxylic acids, which have an odd C number in the aliphatic chain, can especially provide suitable lubricant properties. For example, the solidification point of these esters can be significantly lower compared to the solidification point of esters of monocarboxylic acids with an aliphatic chain with an even C number.

In one preferred aspect of the use the monocarboxylic acids can be selected from the group consisting of C5-C9 monocarboxylic acids. The group of esters from TCD and monocarboxylic acids with an average C number can contribute to lubricants solidifying only at very low temperatures. In addition, these esters may comprise a particularly suitable viscosity index, and the viscosity index of these compounds may preferably be greater than 70. These physical and rheological properties may help to obtain improved lubricating properties at lower temperatures.

In a further preferred characteristic of the use the monocarboxylic acids can be selected from the group consisting of straight-chain C5-C9 monocarboxylic acids comprising an odd C-number. Especially the aliphatic monocarboxylic acids with a carbon chain of 5, 7 or 9 carbon atoms as ester components to TCD can lead to particularly suitable lubricants. These monocarboxylic acids can be combined with either the TCD mono-alcohol or the diol to form esters with particularly low solidification points. Furthermore, these esters can also have a suitable density with values above 1 $g/cm^3$. Furthermore, these esters of monocarboxylic acids with an average C-number may comprise a particularly suitable, high viscosity index.

In a preferred embodiment of the use the esters can be esters of octahydro-4,7-methano-1H-indene-5-methanol. Especially in the field of lubricants for refrigeration devices or other low-temperature applications, the esters of TCD with only one alcohol group have proven to be particularly suitable. These esters can exhibit particularly low solidification points of less than −70° C. Furthermore, these esters may exhibit a particularly suitable viscosity profile, with the viscosity index of these esters being in the range of greater than or equal to 100. These properties can mean that refrigeration systems, engines, gearboxes or turbines can be operated with particularly low maintenance and a long service life even at sub-zero temperatures.

Within a further preferred embodiment of the use the esters can be esters of straight-chain C5-C9 monocarboxylic acids comprising an odd C-number. In particular, the monoesters of TCD with straight-chain monocarboxylic acids with a medium C-number can lead to particularly suitable lubricants. In particular, this group of esters can exhibit very low solidification points and a high viscosity index. Furthermore, these esters have a particularly suitable low intrinsic viscosity, which in particular means that even at very low temperatures the absolute viscosity of the esters does not become too high. Even at very cold temperatures, a sufficiently low-viscosity lubricant film is formed, which can protect mechanical parts very well against wear.

Further according to the invention are low-temperature lubricant compositions comprising greater than or equal to 70% by weight and less than or equal to 100% by weight esters of octahydro-4,7-methano-1H-indene-5-methanol or -dimethanol and aliphatic, straight-chain or branched C2-C9 monocarboxylic acids or mixtures of these monocarboxylic acids. Also according to the invention are low-temperature lubricant compositions which contain a high proportion by weight of the esters which can be used according to the invention. These lubricant compositions can be used over a wide temperature range, have a suitable viscosity and solidify only at very low temperatures. In addition to this wide temperature application range, these lubricants exhibit suitable viscous properties, particularly at low temperatures, so that the mechanical parts of refrigeration equipment can be protected very efficiently from wear even when used continuously at very low temperatures. The lubricant compositions are also extremely chemically stable, so that only a low degree of chemical degradation of the lubricant occurs even under unfavorable operating conditions. For the further advantages of the lubricant compositions according to the invention, explicit reference is made to the advantages of the use of the lubricant esters according to the invention. In addition to the esters which can be used according to the invention, the lubricant compositions can also comprise further additives known to the skilled person.

In a preferred embodiment of the lubricant composition the esters can be esters of octahydro-4,7-methano-1H-indene-5-methanol and aliphatic, straight-chain C5-C9 monocarboxylic acids comprising an odd C-number or mixtures thereof. Lubricant compositions of monoesters of TCD with the above group of monocarboxylic acids may have particularly suitable lubricant properties for applications in the cold. Lubricant compositions containing these esters may have particularly suitable viscous and chemical properties, such as a very low solidification point and suitable viscosity even at low temperatures. As a result, these lubricant compositions can operate over a wide temperature range and lead to improved service life of refrigeration equipment. The lubricant compositions can preferably consist of greater than or equal to 85 percent by weight, and further of greater than or equal to 95 percent by weight of the esters usable according to the invention.

Figure 2:
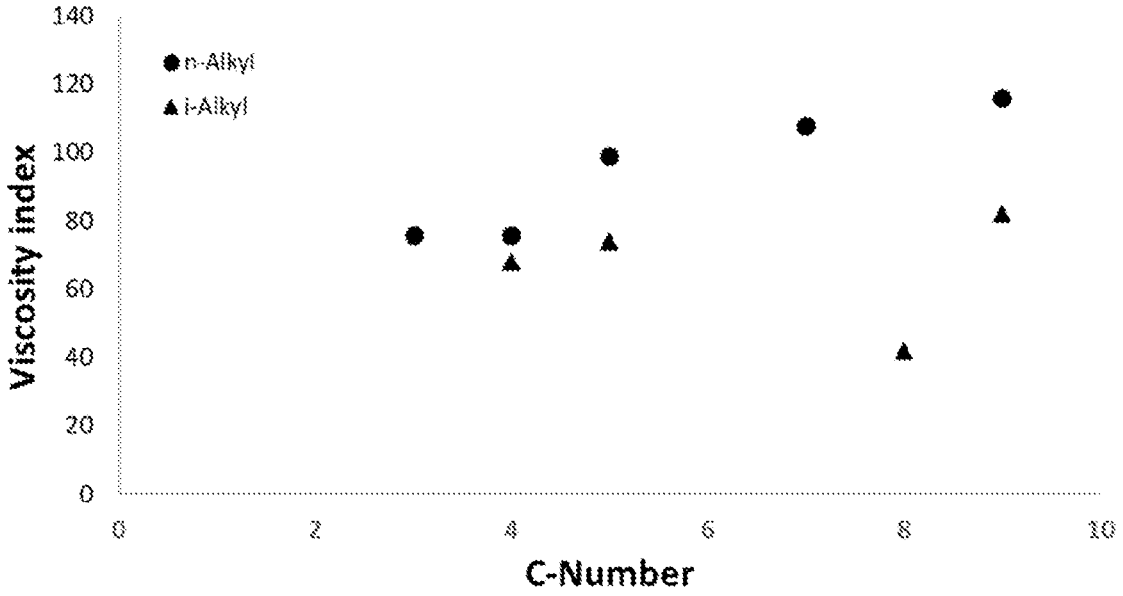
FIG. 2 is a diagram showing the dependence of the viscosity index of TCD M esters as a function of the C number in the alkyl chains of the monocarboxylic acids.
Figure 3:
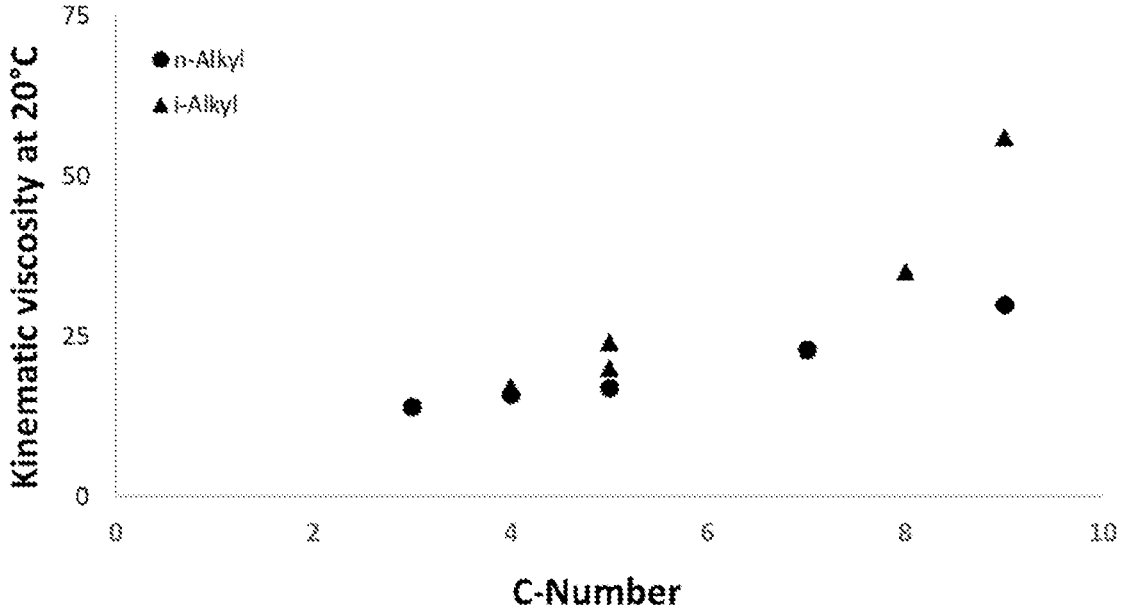
FIG. 3 is a diagram showing the dependence of the kinematic viscosity of TCD M esters as a function of the C number in the alkyl chains of the monocarboxylic acids.
Figure 4:
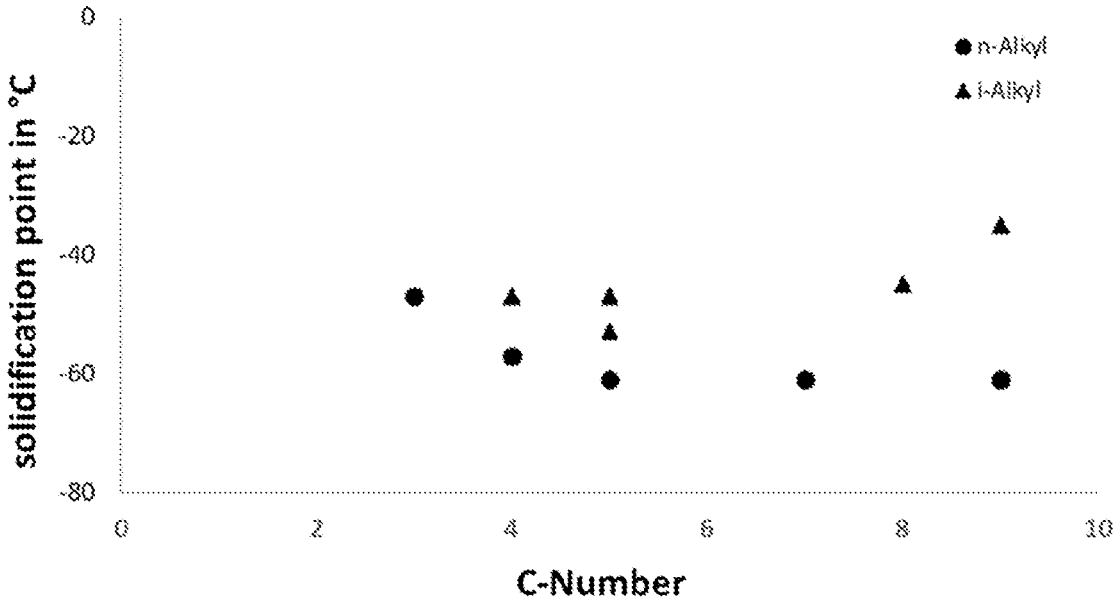
FIG. 4 is a diagram showing the dependence of the solidification point of TCD DM esters as a function of the C-number in the alkyl chains of the monocarboxylic acids.
Figure 5:
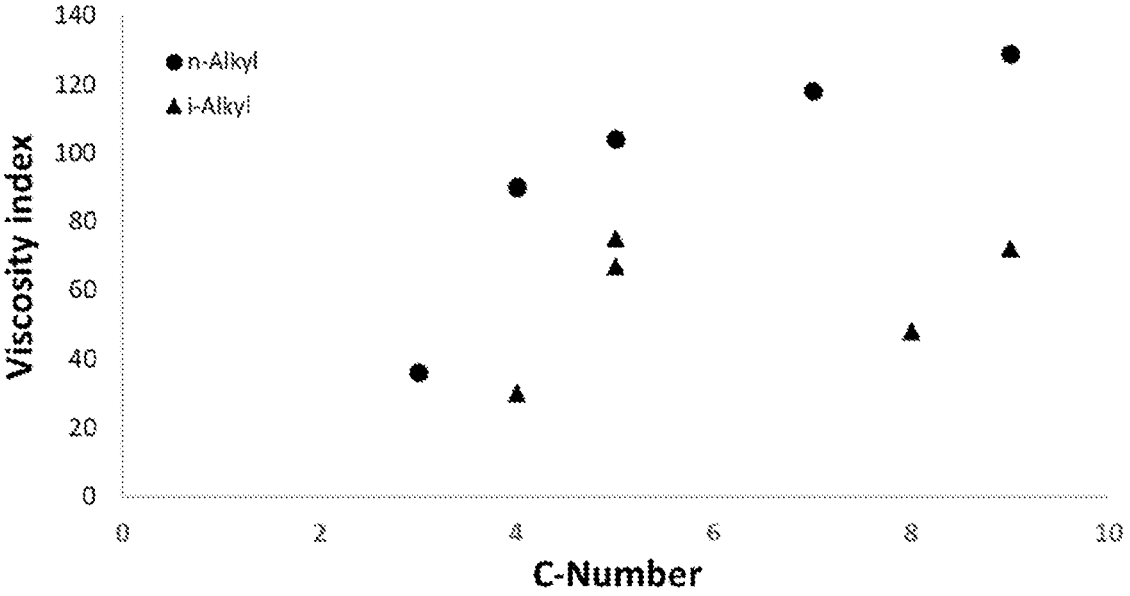
FIG. 5 is a diagram showing the dependence of the viscosity index of TCD DM esters as a function of the C number in the alkyl chains of the monocarboxylic acids.

Further details, features and advantages of the subject matter of the invention will be apparent from the dependent claims and from the following description, figures and associated examples. The figures show:

FIG. 1 a diagram showing the dependence of the solidification point of TCD M esters as a function of the C number in the alkyl chains of the monocarboxylic acids;

FIG. 2 a diagram showing the dependence of the viscosity index of TCD M esters as a function of the C number in the alkyl chains of the monocarboxylic acids;

FIG. 3 a diagram showing the dependence of the kinematic viscosity of TCD M esters as a function of the C number in the alkyl chains of the monocarboxylic acids;

FIG. 4 a diagram showing the dependence of the solidification point of TCD DM esters as a function of the C-number in the alkyl chains of the monocarboxylic acids;

FIG. 5 a diagram showing the dependence of the viscosity index of TCD DM esters as a function of the C number in the alkyl chains of the monocarboxylic acids;

FIG. 6 a diagram showing the dependence of the kinematic viscosity of TCD DM esters as a function of the C number in the alkyl chains of the monocarboxylic acids.

FIG. 1 shows the dependence of the solidification point (pour point) in ° C. of TCD M esters as a function of the C-number in the alkyl chains of the monocarboxylic acids used for ester formation. The results for esters with branched (triangles) or straight-chain (circles) alkyl chains are shown differently. The solidification point was measured according to ASTM D 5950/D 5985. It can be clearly seen that solidification points for the mono-esters according to the invention of below −60° C. can be achieved. Furthermore, it can be seen that compared to the esters with branched alkyl chain, esters of monocarboxylic acids with unbranched alkyl chain with the same C number in the alkyl chain give lower solidification points. This is also confirmed by comparing the values for nC5-TCD M esters and 2 MB and 3 MB. Compared to the esters of carboxylic acids with even C-number, the esters with odd C-number in the alkyl chain show lower solidification points for the mono-esters.

FIG. 2 shows the dependence of the viscosity index of TCD M esters as a function of the C number in the alkyl chains of the monocarboxylic acids used for ester formation. The results for esters with branched (triangles) or straight-chain (circles) alkyl chains are shown differently. The viscosity index is obtained from ASTM D 2270, and it can be clearly seen that the viscosity index of the mono-esters according to the invention is above 40. Furthermore, it can be seen that compared to the esters with unbranched alkyl chain, esters of monocarboxylic acids with branched alkyl chain with the same C-number in the alkyl chain provide lower viscosity indices. Compared to the esters from carboxylic acids with even C-number, the esters with odd C-number in the alkyl chain show higher viscosity indices for the mono-esters.

FIG. 3 shows the dependence of the kinematic viscosity at 20° C. of TCD DM esters as a function of the C number in the alkyl chains of the monocarboxylic acids used for ester formation. The results for esters with branched (triangles) or straight-chain (circles) alkyl chains are shown differently. Kinematic viscosity at different temperatures was obtained according to ASTM D 445. It can be clearly seen that the kinematic viscosity of the mono-esters according to the invention is above about 10 $mm^2/s$. Furthermore, it can be seen that compared to the esters with unbranched alkyl chain, esters of monocarboxylic acids with branched alkyl chain with the same C number in the alkyl chain provide higher kinematic viscosities. The increase in kinematic viscosity is also greater than the increase in viscosity for the n-alkyl esters. For the data point with a C number of 5, 2 different stereoisomers were measured (TCD DM-2 MB ester and TCD DM-3 MB ester with MB methyl butyric acid).

FIG. 4 shows the dependence of the solidification point (pour point) in ° C. of TCD DM esters as a function of the C number in the alkyl chains of the monocarboxylic acids used for ester formation. The results for esters with branched (triangles) or straight-chain (circles) alkyl chains are shown differently. It can be clearly seen that the solidification points of the di-esters of the invention can be reached from below −40° C. Furthermore, it can be seen that compared to the esters with branched alkyl chain, esters of monocarboxylic acids with unbranched alkyl chain with the same C number in the alkyl chain provide lower solidification points (for example, C4). Compared to the esters from carboxylic acids with even C-number, the esters with odd C-number in the alkyl chain show lower solidification points for the di-esters.

FIG. 5 shows the dependence of the viscosity index of TCD DM esters as a function of the C number in the alkyl chains of the monocarboxylic acids used for ester formation. The results for esters with branched (triangles) or straight-chain (circles) alkyl chains are shown differently. It can be clearly seen that the viscosity index of the di-esters according to the invention is above 20. Furthermore, it can be seen that compared to the esters with unbranched alkyl chain, esters from monocarboxylic acids with branched alkyl chain with the same C number in the alkyl chain provide lower viscosity indices. Compared to the esters from carboxylic acids with even C-number, the esters with odd C-number in the alkyl chain show higher viscosity indices for the di-esters.

FIG. 6 shows the dependence of the kinematic viscosity at 20° C. of TCD DM esters as a function of the C number in the alkyl chains of the monocarboxylic acids used for ester formation. The results for esters with branched (triangles) or straight-chain (circles) alkyl chains are shown differently. It can be clearly seen that the kinematic viscosity of the di-esters of the invention is above about 50 mm2/s. Furthermore, it can be seen that compared to the esters with unbranched alkyl chain, esters of monocarboxylic acids with branched alkyl chain with the same C number in the alkyl chain provide lower kinematic viscosities. The increase in kinematic viscosity of the i-alkyl esters is greater than the increase in viscosity for the n-alkyl esters. For the data point with a C number of 5, 2 different stereoisomers were measured (TCD DM-2 MB ester and TCD DM-3 MB ester with MB methyl butyric acid).

Preparation of the Ester

The esters were prepared as follows:

1. Esterification of alcohol and acid with a 10% molar excess of acid until the theoretical removal of water was reached. Titanium isopropoxide was used as catalyst (0.45 mmol to 1 mol diol). Toluene (40 wt. % based on TCD alcohol) was used as a water entrainer in the reaction. To achieve higher temperatures in the esterification, the addition of toluene can be omitted.
2. Main-Strip to remove excess acid in vacuo;
3. Steam-Strip including carbon addition to destroy the catalyst and to decolorize and subsequent drying;
4. eventually NaOH neutralization in order to reduce the acid number and subsequent drying.

The invention claimed is:

1. A method of lubricating a refrigeration system, comprising utilizing as lubricant, at temperatures of −20° C. to −40° C. the reaction product of esters of octahydro-4,7-methano-1H-indene-5-methanol or -dimethanol and aliphatic C5-C9 monocarboxylic acids wherein the monocarboxylic acids are selected from the group consisting of aliphatic straight-chain C5-C9 monocarboxylic acids comprising an odd C-number and the reaction product exhibits a pour point of less than −50° C.

2. Low-temperature compositions, comprising greater than or equal to 70% by weight and less than or equal to 100% by weight esters of octahydro-4,7_methano-1H-indene-5-methanol or -dimethanol and aliphatic, straight-chain C5-C9 monocarboxylic acids or mixtures of these monocarboxylic acids comprising an odd C-number and exhibit a pour point of less than −50° C.

3. Low-temperature compositions according to claim 2, wherein the compositions exhibit a pour point of less than −70° C.

4. Low-temperature compositions according to claim 2, wherein the esters of octahydro-4,7methano-1H-indene-5-methanol or -dimethanol and aliphatic, straight-chain C5-C9 monocarboxylic acids include esters having the structural unit I:

I

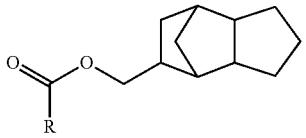

wherein R has 5-9 carbon atoms.

5. Low-temperature compositions according to claim 2, wherein the esters of octahydro-4,7methano-1H-indene-5-methanol or -dimethanol and aliphatic, straight-chain C5-C9 monocarboxylic acids include esters having the structural unit II:

II

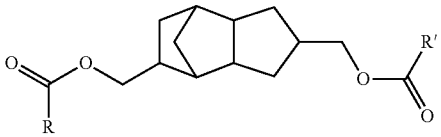

wherein R and R' have 5-9 carbon atoms.

6. The method according to claim 1, wherein the reaction product exhibits a pour point of less than −70° C.

7. The method according to claim 1, wherein the reaction product includes esters having the structural unit I:

I

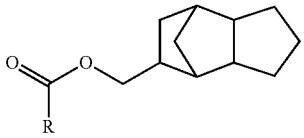

wherein R has 5-9 carbon atoms.

8. The method according to claim 1, wherein the reaction product includes esters having the structural unit II:

II

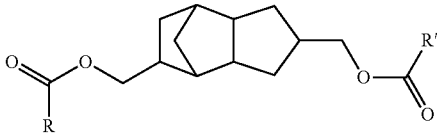

wherein R and R' have 5-9 carbon atoms.

* * * * *